United States Patent [19]

Ammon et al.

[11] Patent Number: 4,932,463

[45] Date of Patent: Jun. 12, 1990

[54] USE OF AC POWER IN ARC SPRAY PROCESS

[75] Inventors: Robert L. Ammon, Baldwin Boro; Raymond W. Buckman, Jr., Pleasant Hills, both of Pa.

[73] Assignee: Westinghouse Electric Corp., Pittsburgh, Pa.

[21] Appl. No.: 257,916

[22] Filed: Oct. 14, 1988

[51] Int. Cl.[5] ..... B22D 27/00; B05D 1/02

[52] U.S. Cl. ..... 164/496; 164/495; 427/423; 239/81; 239/83

[58] Field of Search ..... 164/46, 495, 496, 97; 427/423; 239/81, 83

[56] References Cited

U.S. PATENT DOCUMENTS

| | | | |
|---|---|---|---|
| 1,940,814 | 12/1933 | Saeger, Jr. | 239/81 |
| 3,606,667 | 9/1971 | Kreider | 164/46 |
| 4,370,538 | 1/1983 | Browning | 239/81 |
| 4,492,337 | 1/1985 | Harrington et al. | 239/81 |
| 4,518,625 | 5/1985 | Westfall | 427/422 |
| 4,740,395 | 4/1988 | Tsunekawa et al. | 427/423 |

*Primary Examiner*—Richard K. Seidel

*Attorney, Agent, or Firm*—Fred J. Baehr, Jr.

[57] ABSTRACT

A method of improving an arc spray process for making metal matrix composite monotapes by providing an AC power supply and individually controlled wire feeds to promote even melting of the wires particularly wires formed of metals and alloys having high temperature melting points.

5 Claims, 1 Drawing Sheet

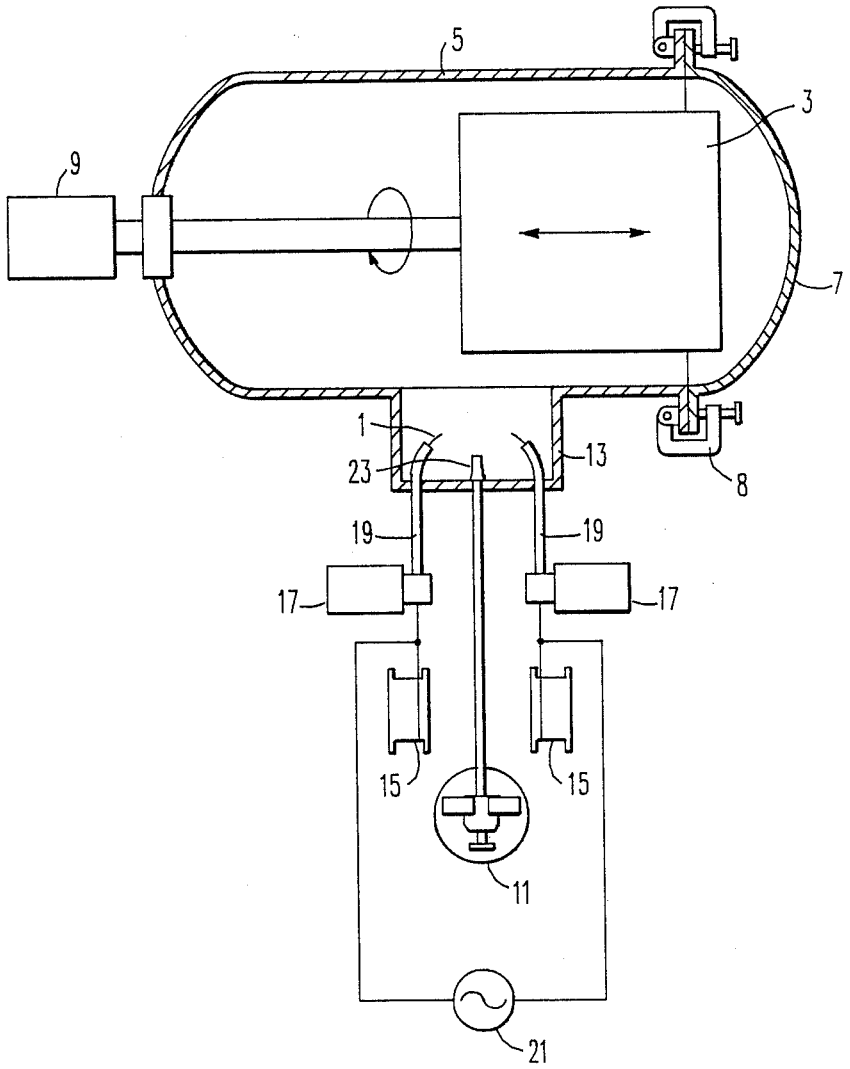
5
3
9
7
1
23
13
8
19
19
17
17
15
15
11
21

USE OF AC POWER IN ARC SPRAY PROCESS

BACKGROUND OF THE INVENTION

The invention relates to the use of AC power in an arc spray process and more particularly to the use of AC power to improve the deposition of high melting point materials to form metal matrix composites and thin foils.

Presently available arc spray processes are depicted in U.S. Pat. No. 4,518,625, which describes the production of metal matrix composite monotapes, which are the precursor for the production of metal matrix composite components. This patent describes the utilization of a DC arc, which adversely affects the arc spray process when materials with high melting points are used. The high melting temperature materials and DC arc produce an unstable melting condition and a non-uniform melting and deposition of the matrix material onto the substrate. The matrix material in the form of two wires is fed uniformly into the arc by a single air driven motor and the non-uniform melting causes large globs of unmelted material to be deposited on the substrate resulting in defects in the composite monotapes.

SUMMARY OF THE INVENTION

Among the objects of this invention is to provide even melting of two wires made of materials with widely different and/or high melting temperatures to produce a deposit on a substrate which is uniform and free of large globs of partially melted lumps of matrix material.

In general, a method of improving arc spray deposition of high melt point materials and/or materials with different melting points, when performed in accordance with this invention, comprises feeding the distal end of two wires toward each other at a controlled rate, providing AC power to the wires with sufficient voltage to produce an arc, which melts the ends of the wires and directing a high velocity stream of inert gas through the arc and toward the mandrel to disburse the melted wire over the array of fibers overlaying the mandrel to form a metal matrix fiber reinforced composite monotape or a thin foil.

BRIEF DESCRIPTION OF THE DRAWINGS

The invention as set forth in the claims will become more apparent by reading the following detailed description in conjunction with the accompanying drawing, in which:

The Sole Figure is a schematic drawing showing arc spray apparatus utilized to perform the invention.

DESCRIPTION OF THE PREFERRED EMBODIMENTS

Referring now to the sole figure in detail there is shown a schematic of apparatus for depositing spray from wires 1 melted by an arc on a mandrel 3. The mandrel 3 is disposed in a vessel 5 having a head 7 sealably affixed to the vessel by hinged C-clamps 8. The mandrel 3 is removably attached to a drive mechanism 9, which rotates the mandrel 3 and moves it axially within the vessel 5 causing the metal spray stream from the arc spray to trace a spiral path on the outer surface of the mandrel 3. The mandrel 3 may also be driven in such a manner that the metal spray stream from the arc spray traces a path that moves rapidly in an axial direction back and forth across the surface of the mandrel 3 while the mandrel slowly rotates. A vacuum pump (not shown) is used to evacuate the vessel 3 prior to filling it with inert gas supplied from a tank 11. An arc spray chamber 13 is disposed on one side of the vessel 5 and opens thereto. A pair of wire feeding devices comprising a pair of spools 15 containing the desired wire, a pair of variable speed independently controlled wire drive mechanisms 17 and a pair of wire tubes 19 that are adapted to feed two wires 1 into the arc spray chamber 13 so that the distal ends of the wires 1 move toward each other at a controlled rate. An alternating current or AC power supply 21 is connected to the wires 1 to apply a sufficiently high AC voltage to the wires to produce an arc between the distal ends of the wires 1 causing the distal ends to melt. Inert gas from the tank 13 is feed through a nozzle 23 to produce a high velocity stream, which blows a stream of molten metal from the distal ends of the wire 1 toward the mandrel 3.

The method of operating this apparatus to make a metal composite monotape or a thin foil is as follows:

The spools 15 are wrapped with wire 1, the wire 1 may be from a group of wires with high melting temperatures such as niobium, molybdenum, tungsten, tantalum, rhenium or any other metal or metal alloy. The same or different wires can be wrapped on each spool 15 depending on the desired properties of the matrix to be formed. When producing a metal composite monotape the mandrel 3 is sprayed with a commercially available mold release agent and overlaid with an array of high strength fibers such as tungsten alloy, silicon carbide or any other fiber. Whereas, when producing a thin foil the step of overlaying the mandrel 3 with an array of fibers is omitted. The mandrel 3 is then connected to the drive mechanism 9, which is adapted to rotate the mandrel 3 and moves it axially causing the metal spray stream to trace a spiral path across the outer surface of the mandrel 3 or to rapidly translate the mandrel 3 axially back and forth while it rotates slowly. The vessel 5 is purged, evacuated and filled with an inert gas such as argon. The wire 1 from the spools 15 is feed through the wire drives 17 and wire tubes 19 into the spray chamber 13. Inert gas is supplied through the nozzle 23. The mandrel drive mechanism 9 rotates and translates the mandrel 3 axially causing a spiraling motion relative to the spray stream of molten metal. An alternating current or AC power supply 21 is connected to the wire tubes 19 to produce sufficient AC voltage between the wires so that as the distal ends of the wires 1 approach each other an arc is formed creating sufficient heat to melt the distal ends of the wires 1. The inert gas flowing through the nozzle 23 at high velocity disbursing molten metal from the distal ends or the wire 1 in a molten stream directed toward the mandrel 3 upon which it impinges, collects and solidifies overlaying the array of fibers forming a metal matrix composite monotape or overlaying the bare mandrel 3 forming the thin foil.

Providing an alternating current or AC power supply 21 allows the distal ends of the wires 1 to melt at an even rate. However, if a direct current or DC power supply is utilized, there is a partition of DC power in the DC arc, whereby the anode temperature is higher than the cathode temperature due to a difference in anode and cathode voltage drop in the DC arc plasma. This causes the anode wire to melt more rapidly than the cathode wire, resulting in uneven or non-uniform melting of the wire 1 and globs of unmelted material being deposited on the mandrel 3. The alternating current or AC power supply 21 on the other hand produces a uniform partition of power as the anode and cathode are switched sixty times in a second resulting in uniform melting of the wires 1 and a uniform deposition of molten metal on the mandrel 3 without globs of unmelted metal. The partition of power in a DC arc plasma has a much greater effect as the melting temperature of the wire 1 increases, making this improved method of operating an arc spray apparatus utilizing an AC power supply 21 a necessity, when metals or alloys with high temperature melting points are utilized to form the matrix of a fiber reinforced composite monotape or a thin foil.

Accurate control of the rate at which the wire 1 is feed is also very important to produce uniform melting and must be set to provide the proper feed rate for, if the feed is too fast, the wires 1 come together and short out and if the feed rate is too slow, the resistance of the arc increases reducing the current and power and thus the energy necessary to melt the wires 1, which becomes more of a problem as the melt points of the wires increase in temperature.

The method hereinbefore described advantageously provides precise feed control of each wire 1 producing uniform power through the deposition and providing an AC power source 21 that changes the anode and cathode sixty times a second substantially eliminating the problem of the uneven partition of power between the anode and cathode resulting in the elimination of globs of unmelted metal in the deposited overlay.

While the preferred embodiments described herein sets forth the best mode to practice this invention presently contemplated by the inventors, numerous modifications and adaptations of this invention will be apparent to others skilled in the art. Therefore, the embodiments are to be considered as illustrative and exemplary and it is understood that numerous modifications and adaptations of the invention as described in the claims will be apparent to those skilled in the art. Thus, the claims are intended to cover such modifications and adaptations as they are considered to be within the spirit and scope of the invention.

What is claimed is:

1. A method of improving arc spray deposition of high melt point materials on a moving mandrel to form an overlay comprising the steps of:

feeding the distal ends of two wires toward each other at a controlled rate;

providing AC power to the wires with sufficient electrical potential therebetween to produce an arc as the distal ends of the wires approach each other to melt the distal ends of the wire at equal rates;

directing a high velocity stream of inert gas through the arc and toward the mandrel to disburse the melted wire and direct it in a stream toward the mandrel whereon it solidifies forming the overlay.

2. The method of claim 1, wherein the step of feeding the distal ends of two wires toward each other comprises feeding wire formed from a group of metals having a high melting temperature such as niobium, molybdenum, tungsten, tantalum and rhenium.

3. The method of claim 1 and further comprising the step of applying a release agent to the mandrel.

4. The method of claim 3 and further comprising the step of wrapping the mandrel with an array of high strength fibers prior to applying the overlay thereto to form a metal matrix composite monotape.

5. The method of claim 3, wherein the overlay is applied to the mandrel directly over the release agent to form a thin foil.

* * * * *